United States Patent [19]

Reilly et al.

[11] 4,439,056

[45] Mar. 27, 1984

[54] MACHINE SUITABLE FOR BREAKING CONCRETE PAVEMENT IN PLACE

[75] Inventors: Clair H. Reilly; Robert M. Reilly, both of Ossian, Iowa

[73] Assignee: Pettibone Corporation, Chicago, Ill.

[21] Appl. No.: 282,886

[22] Filed: Jul. 13, 1981

[51] Int. Cl.[3] ..... E01C 19/34; B25D 17/28

[52] U.S. Cl. ..... 404/90; 299/37; 299/69; 173/90; 173/139

[58] Field of Search ..... 404/90, 133, 113; 299/37, 69, 70; 173/24, 28, 139, 82, 116

[56] References Cited

U.S. PATENT DOCUMENTS

| | | | |
|---|---|---|---|
| Re. 25,401 | 6/1963 | Clynch | 404/113 X |
| 894,269 | 7/1908 | Hendron | 404/90 X |
| 1,654,014 | 12/1927 | Proctor | 404/133 |
| 2,335,172 | 11/1943 | Cornett | 173/28 |
| 2,659,583 | 11/1953 | Dorkins | 404/133 X |
| 2,659,584 | 11/1953 | Dorkins | 404/133 X |
| 2,893,299 | 7/1959 | Moir | 404/113 |
| 3,172,483 | 3/1965 | Spitzer | 173/28 X |
| 3,253,522 | 5/1966 | Piper | 404/113 |

*Primary Examiner*—Nile C. Byers, Jr.
*Attorney, Agent, or Firm*—Louis Robertson

[57] ABSTRACT

For progressively breaking-in-place concrete of roadways or the like, a vertically extending diesel power driver, of a type used as a pile driver, but with a concrete-breaking shoe forming its lower end, is advanced by a towed chassis. Guide angles at the upper portion of the power driver, cooperating with a guide bar vertically disposed, guide the power driver in its conventional rythmic bobbing, with sufficient looseness to permit the power driver to have a pendulum like swinging action. This swinging action results from relatively intermittent movement of the bottom portion of the power driver while the top portion is advanced more steadily by the chassis. Shoe-towing means extend forwardly from the shoe to a hanging link which is resiliently biased forwardly to tow the shoe. The biasing is provided by long-throw cushions. The forwardly extending shoe-towing means is flexible, to prevent damage when the shoe is driven deeply. The guide angles have moderately long, slightly convex faces to withstand pounding by the guide bar.

8 Claims, 4 Drawing Figures

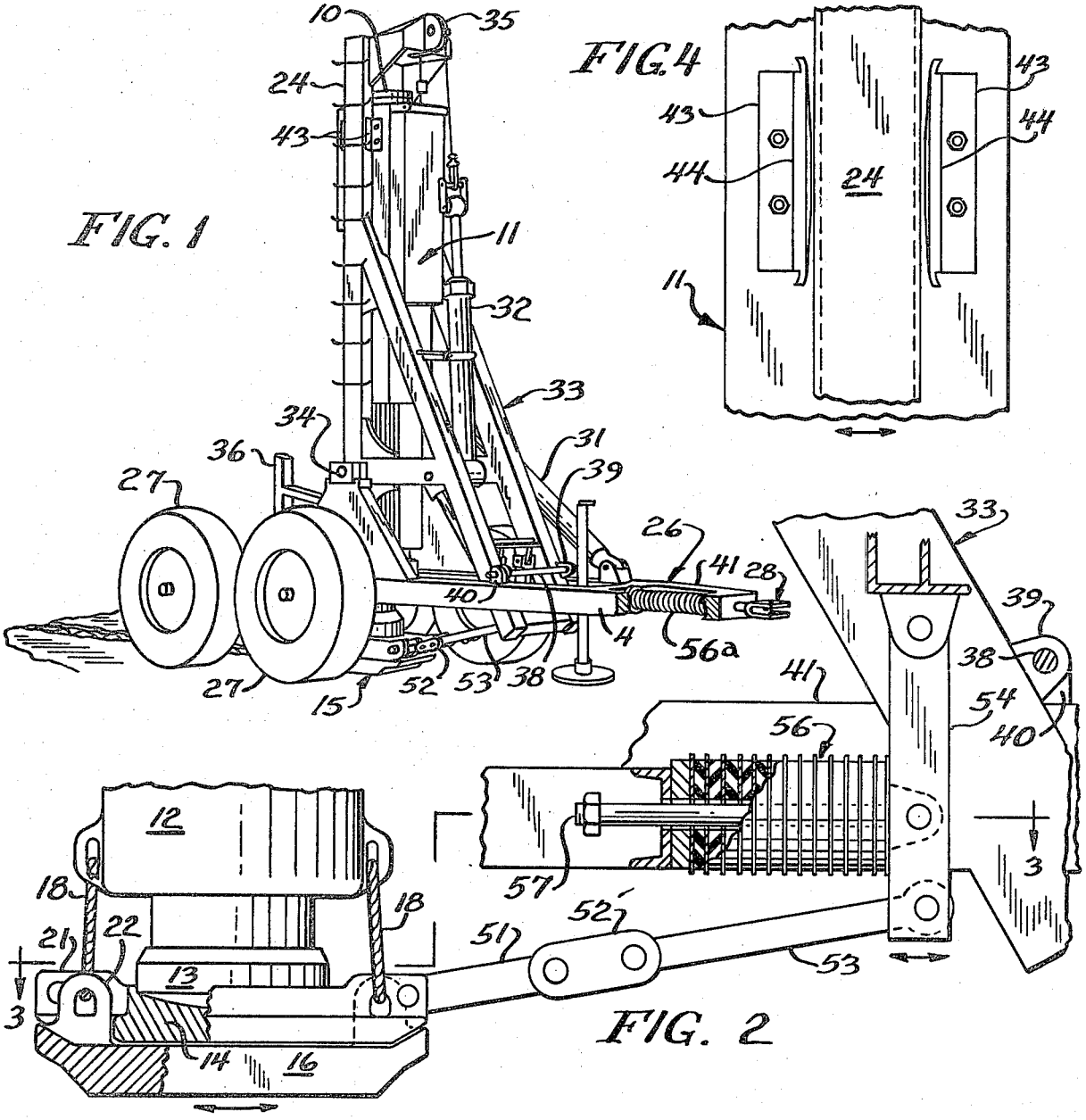
FIG. 1
FIG. 4
FIG. 2
10
35
24
43
11
32
33
34
36
31
39
27
26
41
28
40
4
56a
15
52
53
38
12
18
21
22
13
14
16
3
51
54
56
57
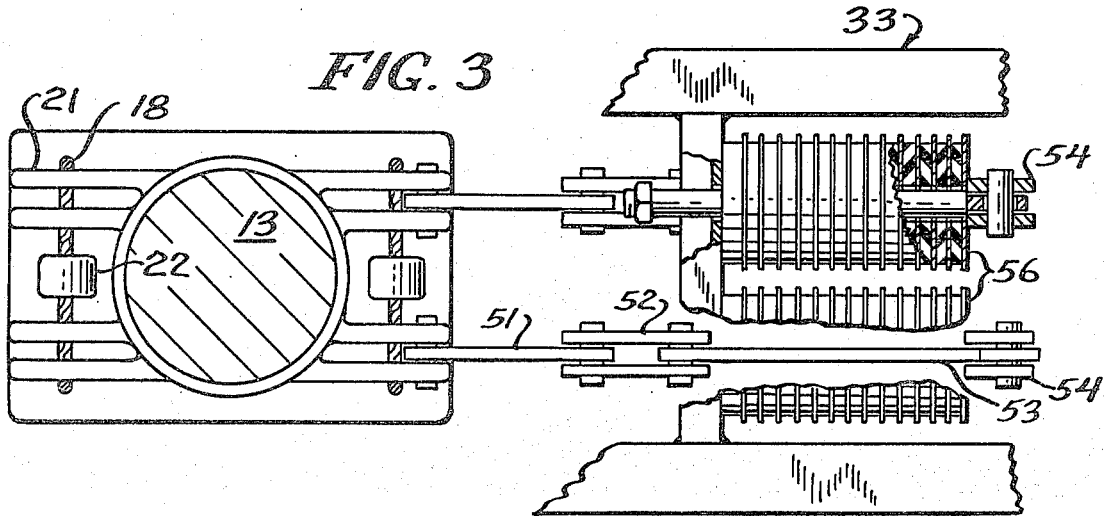
FIG. 3
33
21
18
13
22
54
56
52
51
53

MACHINE SUITABLE FOR BREAKING CONCRETE PAVEMENT IN PLACE

INTRODUCTION

The invention of which this disclosure is offered for public dissemintaion in the event that adequate patent protection is available, relates to machines suitable for breaking concrete roadways in place. In common with previous such machines, this invention uses a power driver, of the type better known as a pile-driver, mounted on a chasis and towed along the concrete pavement with its heavy blows breaking off successive chunks of the concrete. The chunks, stripped from any reinforcing steel, can be fed to a nearly portable crushing plant and recycled. Great sums of money can be saved, as compared to buying fresh crushed rock or gravel, especially if long hauling would be needed.

Although past machines of this class have done their job satisfactorily, and have already saved enormous amounts, they have been troublesome. There has long been recognition that a main source of the trouble was the constant fighting between the steady movement of the towing tractor and the necessarily interrupted type of movement of the hammer-head or block-like shoe delivering the blow to the pavement. To do its job, the shoe must strike with a blow heavy enough to break through beyond the top plane of the pavement, and in its resulting position its forward movement with the towing vehicle is blocked by the still unbroken pavement. One device for accomodating this interrupted movement has long been in use. This is a cushioned tow-hitch that would let the chassis lag with the shoe, more or less, and then jump ahead to catch up with the towing tractor. However, the power driver is capable of delivering about 90 blows a minute, and stopping and starting the chassis and parts necessarily moving with it at that frequency was clearly not the total solution to the problem. The impression was that everything was being shaken to pieces. Efforts have been made to let the chassis move more steadily by applying something in the nature of a cushioned tow between the chassis and the shoe, so that the shoe could do the necessary lagging while the chassis went on moving. Until the present invention, these efforts have not been successful, because the tow links to the shoe would hit the unbroken pavement whenever the shoe penetrated too far. This caused excessive breakage of the tow links, so that this effort had to be abandoned. Also, it was found that this cushioned towing of the shoe caused a pendulum-like swinging of the power driver that its slide-guides could not withstand.

According to the present invention, success is made out of failure in the idea of cushioned towing of the shoe by finding ways to overcome both of the faults mentioned. Breakage of the tow links is completely prevented by making them flexible. The power driver's slide guides are redesigned to be suitable for the pendulum-like swinging. This is not merely in spacing them to give room for the swinging, but also in giving them adequate faces at the different angles of impingement resulting from the pendulum-like swinging.

Advantages of the invention may be more apparent from the following description and from the drawings.

DESIGNATION OF FIGURES

FIG. 1 is a perspective view of a preferred form of machine embodying this invention, in use, some details being omitted.

FIG. 2 is a view partly in vertical section showing details of the flexible and cushioned shoe-tow of this invention.

FIG. 3 is a view partly in horizontal section, taken approximately along the irregular line 3—3 of FIG. 2.

FIG. 4 is a side view showing especially the slide guides spaced and shaped according to this invention to accomodate and withstand the pendulum-like swinging of the power driver.

BACKGROUND DESCRIPTION

In many respects the illustrated embodiment of the invention is like its predecessors. The power for the heavy blows breaking concrete pavement is delivered by a power driver 11 of a type more commonly used as a pile driver. One which has been extensively used for this purpose is Link Belt's 440 Diesel Pile Hammer. For the most part its details are not shown or described, being unchanged by the present invention. It is a heavy structure of which the main operating part is a floating ram which reciprocates vertically during running. In its downward movement it compresses air in a cylinder forming a combustion chamber at its lower end. Like a Diesel engine, it fires when fuel is injected into the highly compressed gas in its combustion chamber. This explosion exerts pressure equally downward to drive an anvil piston in hammer-like action, and the floating ram upwardly. Its upper end also acts like a piston and at the end of its up-stoke it compresses air in its cylinder, and this drives it back downwardly to repeat the cycle. Details of construction and operation need not be described here, being unchanged. To a large extent they are explained in Link Belt's catalog No. 3901A-9-66 incorporated here by reference in case details need be added.

The bottom or "business end" of the power driver is seen in FIG. 2. The anvil piston mentioned is located within anvil retainer 12, and drives adapter assembly 13. Usually this would engage a block assembly for driving a pile, but in FIG. 2 it fits into and drives upper casting 14 of a shoe assembly 15 which includes also lower casting or shoe sole 16. A cable 18, or a pair of cables 18, strung through ears on anvil retainer 12, and ears 21 and 22 on upper and lower castings 14 and 16 respectively, hold the shoe in place, somewhat loosely.

Power driver 11 is held erect by uprights 24 (the one on the far side not showing in FIG. 1). This is carried by, or may be considered part of, a mobile chassis 26 provided with wheels 27. The manner of towing this chassis need not be described, as it may remain unchanged. Successful operation in past years has included a long-cushioned hitch 28 with the towing vehicle or tractor, permitting the chassis to move with an interrupted or irregular movement while the tractor advanced steadily. The tractor also provides hydraulic power for control cylinders 31 and 32. Cylinder 31 operates tilt frame 33, which includes uprights 24, to tilt it back about pivots 34 onto rests 36 for travel when not operating. After double-acting cylinder 31 raises tilt frame 33 and power driver 11 to the position shown, frame 33 is locked in operating position by inserting lock bar 38 through ears 39 on tilt frame 33 and ears 40 on main frame 41 of chassis 26.

Cylinder 32 is part of the power driver, or an adjunct of it, performing the same functions as before, especially in preparing it for starting. It can also be used for raising the main power driver body 11 when necessary. During operation it is idle and its cable is slack. Its cable runs over sheave 35, carried by tilt frame 33.

For the following explanation of the present invention, it may be helpful to know that upper cylinder 10 and lower cylinder (not shown) terminating with anvil retainer 12 are part of single rigid structure rigidly associated with the more visible parts of the main power driver assembly 11. During operation, this entire unit rythmically bobs up and down.

DESCRIPTION OF PREFERRED FORM OF INVENTION

One aspect of the present invention concerns guide angles 43. It has been previous practice to provide guide angles on driver 11 for guiding the power driver 11 in its up and down bobbing, and when it follows the pile down, or is raised. For piles, they could have a snug sliding fit with their guiding uprights such as uprights 24. According to the present invention guide angles 43 are changed to permit and withstand a pendulum-like swinging of power driver 11.

As seen best in FIG. 4, guide angles 43 are bolted to the body of power driver 11, actually to machined pads thereon as in the past. According to the present invention, their guide flanges 44 are shaped convexly, and have a sufficient spacing from each other, at their centers where closest, to permit the pendulum-like swinging. Their gently convex shaping over a substantial lenth vertically contributes to permitting the swinging, while providing at all times a large enough contact area to withstand the pounding that accompanies the swinging action and intermittent forward movement.

Preferably, the bolt holes in guide angles 43 are oversize so that by loosening the bolts the spacing of the guide angles can be adjusted. It is expected that even if the initial face-shape of flanges 44 is not as shown, but is a simple long-radius arc, flats will develop from wear due to the constant bobbing, and reduction of the extra clearance thus resulting will be desirable. Perhaps the best shape can be determined by experience. Starting with an arc just curved enough to permit the swing occurring, it can be allowed to wear until a relatively enduring shape is reached.

The reason for the above provisions for accomodating a pendulum-like swing of the power driver 11 is that such swinging is the best way to minimize the troublesome effects that result from the inevitable interruption of smooth forward movement every time the power driver 11 drives its shoe 15 downwardly, breaking the concrete pavement. The swinging movement of power driver 11 permits everything else to keep advancing more or less smoothly. The more smoothly the chassis 26 and its tilt frame 33 can advance, the less they will be subjected to trouble-causing vibrations.

Between downward drives of shoe 15 which interrupt its advancing movement, it must jump forwarly so that successive blows will each come down on the edge of unbroken concrete to break off another chunk. This is accomplished by means seen best in FIGS. 2 and 3. Flexible shoe-towing means, illustrated by pivoted links 51, 52 and 53 extend forwardly from the front end of shoe 15 to a hanging link 54 which is biased forwardly by a long-thow biasing device such as multi-pad cushion 56. Actually, as seen in FIG. 3, this shoe-towing means is all duplicated, to provide adequate forward biasing.

Long throw cushion 56 is old in other uses, as at **56*a* in the main tow hitch 28. It includes alternate steel and rubber discs, prevented from buckling excessively by a guide rod 57, with refinements not shown, but known to experts in that art. Guide rod 57 is pivoted to hang link 54 and is long enough to accomodate its maximum movement. Ideally, the vertical position of hang link 54 would be the mid position of its swing. It hangs pivotally from a cross bar 59 forming part of tilt frame 33. The rear end of cushion 56 bears against cross bar 61, also part of tilt frame 33**.

There is some preference for a flexible cable in place of linkage 51,52, 53, as simpler and less costly.

ACHIEVEMENT

The present invention eliminates or reduces much of the trouble encountered in the previous very valuable machines for breaking concrete pavement in place. It permits much smoother advancement of the chassis while the advancement of the driver shoe is necessarily somewhat intermittent. Work output may also be increased under some conditions when optimum movements of the shoe are now more easily achieved. Occurences of excessive looseness at the upper guide angles is substantially eliminated.

MODIFICATIONS AND DETAILS

Although the foregoing description offered for public dissemination is detailed to ensure adequacy and aid unerstanding, this is not intended to prejudice that purpose of a patent which is to cover each new inventive concept therein no matter how others may later disguise it by variations in form or additions or further improvements. The claims which follow are intended as the chief aid toward pointing out the parts improvements or combinations in which the inventive concepts are found. Modifications are mentioned under this heading partly to be sure to satisfy the requirement of disclosing the best form contemplated, whether or not the product of the same inventors, or even would be preferred by them.

A linkage system such as that represnted by links 51, 52 and 53, could be applied to anvil retainer 12, as well as to shoe 15, so that the force for swinging the bottom of the rigid driver structure forwardly will not have to reach it through relatively movable parts. Without that change, it is important that the adapter assembly 13 be deeply seated within the upper casting 14, the engaging walls being vertical as seen in FIG. 2.

The use of guide angles 43 is derived from pile drivers, where the driver must be able to follow the pile downwardly as the pile is driven. Because much shorter vertical movement is sufficient in breaking pavement, some manufacturers may prefer to substitute some other guidance for the top portion of the power driver 11. There could, for example, be generally horizontal toggle links pivoted at one end to the driver's guide angle pads, and at the other end to a fixed part of or extension from the tilt frame 33.

The biasing shown in FIG. 3 could be changed to provide a biasing system with adjustment of the biasing force and with adjustable limiting means for the length of forward swing of the driver.

For adjusting the spacing of guide angles 43, take-up screws may be provided, pushing one of these angles toward the other. There should then be some provision for preventing unscrewing by vibration.

The tilt frame is formed of structural steel members welded together. The opposite side frames are basicly triangular, with extensions, as seen in FIG. 1, and they are joined by sufficient cross bracing for good rigidity.

The hydraulic system for operating the control cylinders 31 and 32 is not shown, being conventional. It is preferred that there be controls in the towing vehicle's cab for the operational control cylinder 32, and also for fuel feed or injection for Diesel driver 11. Swing cylinder 31 is so rarely operated that it does not even need to be connected hydraulicly during operation of the driver.

It is preferred that as swing frame 33 is swung to its operational position shown in FIG. 1, its lower portion, in swinging rearwardly, comes against a forward-thrusting portion of or extending from the chassis 26. This may be a cross brace on the chassis, in which case the bottom end of tilt frame 33 may have rearward extensions from near the bottom of uprights 24 to reach back to the cross brace. It should be understood that occasionally severe loads are imposed, as when the a pavement defect lets the driver 11 and shoe 15 fall through so that the shoe cannot be advanced by shoe tow linkage 51,52 and 53 until the power driver is raised by cylinder 32. Such of the resulting thrust as cannot be taken up by cushions 56 is transmitted through the described abutment with the forward thrusting member to the chassis. It is on such occasions that there is great need for the cushion-hitch of long throw nature that reduces the shock at that point and on the towing vehicle. The frequency of these relatively rare occasions may be reduced by providing an adjustable limit for the downward movement of power driver 11. Since it must not interfere with the normal driver movements, elimination of these occasions may prove to be impossible.

References to chunks of concrete being broken off merely means cracked loose. It is best that the under foundation be such as to support the chunks in place as that facilitates advancement of the shoe.

I claim:

1. A machine suitable for breaking concrete pavement in place including a mobile chassis having guide uprights generally vertical during operation, and a generally vertically disposed power driver having at its lower end a shoe for engagement with the pavement and subject to repetitive downward powered driving action by the power driver with sufficient force to progressively break chunks from the pavement as it is drawn along the pavement, said power driver at its upper portion being free to undergo a bobbing action but being guided at an upper portion thereof for vertical movement by guide angles having flanges and a vertical guide upright, one flange of each angle being associated with the power driver and the other flange of each angle being with the guide uprights, characterized by the improvement in which:

said flange guide angles, and guide uprights are adapted to permit and withstand a pendulum like swinging of the power driver; and the machine also includes cushioned tow means for advancing the lower end of the power driver, including said shoe, with a relatively intermittent movement compared to the relatively constant movement of the chassis; said cushioned tow means further including elongate tow means, vertically flexible between its ends, extending forwardly from said lower end, and biasing means applied to the elongate tow means at the forward end thereof to urge the elongate tow means forwardly with long-stroke yieldability, to permit the shoe to lag when forced through the pavement surface by the driver, but advancing it rapidly between instances of lagging.

2. A machine suitable for breaking concrete pavement in place including a mobile chassis; a power driver moved by the chassis in generally vertical disposition and having at its lower end a shoe for engagement with the pavement and subject to repetitive downward powered driving action by the power driver with sufficient force to progressively break chunks from the pavement as it is advanced by the chassis during intervals between the driving actions; said chassis including means for guiding the upper part of the power driver for vertical bobbing while permitting a pendulum-like swinging movement of the power driver, characterized in that:

said machine further includes long-stroke resilient biasing means acting on the power driver at its lower portion for permitting this portion to lag each time it is driven by the power driver into the pavement, and for moving it rapidly forward in said intervals in response to relatively continuous movement of the chassis; said biasing means being flexible vertically in the vicinity of the bottom of the power driver, and along a portion of the biasing means extending forwardly from a connection of the biasing means to the driver, so as to yield without damage if downward movement of the shoe causes said portion of the biasing means to strike said pavement.

3. A machine suitable for breaking concrete pavement in place according to claims 1 or 2, in which the biasing means includes a stack of alternate discs of compressible and non compressible material and means for preventing excessive buckling when greatly compressed.

4. A machine suitable for breaking concrete pavement in place including a mobile chassis having a tow hitch cushioned to permit intermittent lagging of the chassis with respect to a tow vehicle to which the hitch may be attached; a powered driver moved by the chassis in generally vertical disposition and having at its lower end a shoe for engagement with the pavement; said driver being powered by internal combustion within it which directly drives a portion thereof downwardly to subject the shoe to repetitive downward power driving action with sufficient force to progressively break chunks from the pavement by force exerted by the shoe on the pavement surface on successively reached portions of the surface as the shoe is advanced by the chassis; said chassis including means for guiding the driver at an upper part thereof for vertical bobbing and for accomodation to the pavement, characterized in that:

said machine includes long-stroke resiliently yielding biasing means acting on the lower portion of the driver for permitting this portion to lag each time it is driven by the driver into the pavement, and for moving it rapidly forward in intervals between such times in response to relatively continuous movement of the chassis; said biasing means including a link pivoted to the chassis and extending generally vertically, shoe-tow means connecting a free end of said link to the shoe and having vertical flexibility along its length to avoid damage if portions of the shoe tow means extending forwardly from the shoe should be driven against the pavement, and resilient means biasing said link forwardly; and said means for guiding the driver being constructed to permit pendulum-like swinging of the driver as the shoe alternately lags and advances, and to withstand durably the combined swinging and bobbing action of the driver.

5. A machine suitable for breaking concrete pavement in place according to claim 4, in which the chassis includes a frame tiltable about a pivotal axis which advances the driver and which can be hydraulicly tilted to lay the driver in a generally horizontal position for road travel, and to return it to generally vertical disposition for operation; this tiltable frame being the part of the chassis to which the link is pivoted.

6. A machine suitable for breaking concrete pavement in place according to claim 4 or 5 including a long-stroke cushioned hitch for towing of the chassis.

7. A machine suitable for breaking concrete pavement in place according to claim 5 including means below the pivotal axis of the tilt frame for locking it in generally vertical position and for transmitting drag thrust from the tilt frame to the main frame of the chassis when the shoe cannot advance; and a long-stroke cushioned hitch for towing the chassis.

8. A machine suitable for breaking concrete pavement in place including a mobile chassis; a power driver moved by the chassis in generally vertical disposition and having at its lower end a shoe for engagement with the pavement and subject to repetitive downward powered driving action by the power driver with sufficient force to progressively break chunks from the pavement as it is advanced by the chassis; said chassis including means for guiding the power driver at an upper part thereof for vertical bobbing, characterized in that:

said machine further includes long-stroke resilient biasing means acting between the chassis and the power driver at the lower part thereof for permitting said lower part to lag with respect to the chassis each time the shoe is driven by the power driver into the pavement, and for moving it rapidly forward between said times in response to relatively continuous movement of the chassis, and its means for guiding being constructed to permit the power driver to have a pendulum-like movement.

* * * * *